US005613822A

United States Patent [19]

Gasparini et al.

[11] Patent Number: 5,613,822

[45] Date of Patent: Mar. 25, 1997

[54] DEVICE FOR HOOKING, LIFTING AND UNLOADING A DUSTBIN FOR USE ON SIDE LOADING GARBAGE TRUCK

[75] Inventors: Giorgio Gasparini; Luca Gasparini; Filippo Gasparini, all of Milan, Italy

[73] Assignee: Ecology System International S.r.l., Milan, Italy

[21] Appl. No.: 446,053

[22] Filed: May 19, 1995

[30] Foreign Application Priority Data

May 26, 1994 [IT] Italy ..... MI94A1066

[51] Int. Cl.[6] ..... B65B 21/02

[52] U.S. Cl. ..... 414/408; 414/303; 414/917

[58] Field of Search ..... 414/303, 406, 414/407, 408, 409, 917

[56] References Cited

U.S. PATENT DOCUMENTS 4,349,305 9/1982 Wynn et al. ..... 414/408
4,548,542 10/1985 Reese ..... 414/409
5,419,671 5/1995 Smith et al. ..... 414/408

FOREIGN PATENT DOCUMENTS 312900 4/1989 European Pat. Off. ..... 414/408
763204 9/1980 U.S.S.R. ..... 414/408

*Primary Examiner*—Thomas J. Brahan
*Attorney, Agent, or Firm*—Notaro & Michalos P.C.

[57] ABSTRACT

A device for hooking, lifting and dumping a dustbin, of the type for use on a truck having sidewise loading. The device has two arms that are pivotally connected to each other and a third arm (16) provided with a catch for hooking the dustbin and hinged to the one of the arms. A lever is secured to the one arm and a plunger is provided that is hinged, on one side, to the lever and, on the other side, to the other arm at a pivot point so as to achieve, together with the other arm and the lever, a four-bar linkage. The plunger consist of an extensible arm so as to cause the four-bar linkage to assume two different configurations, one during progressing towards a dustbin, the other during lifting and rotating thereof.

10 Claims, 9 Drawing Sheets

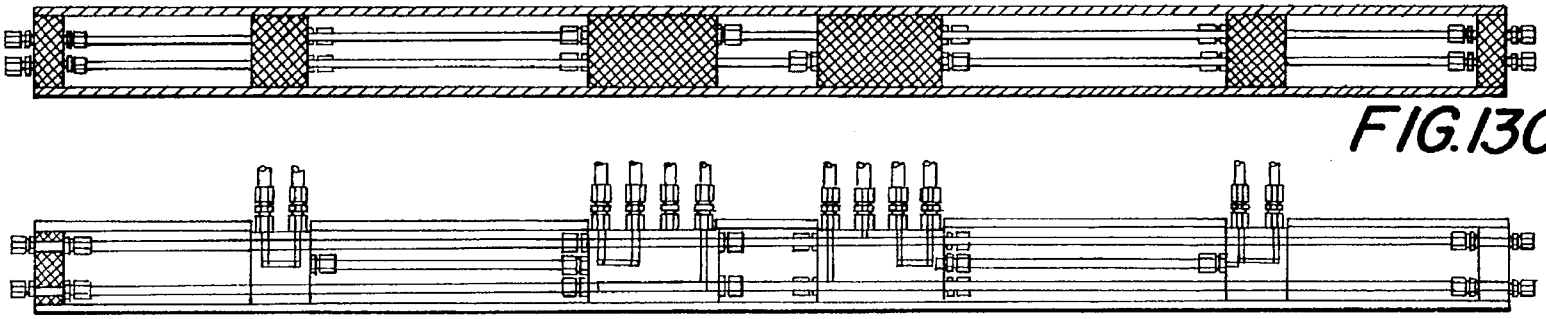
FIG.13C
FIG.13D
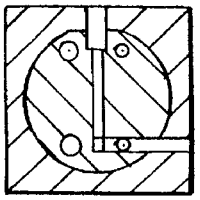
FIG.13G
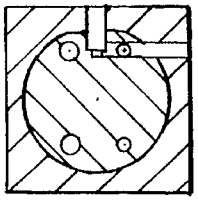
FIG.13F
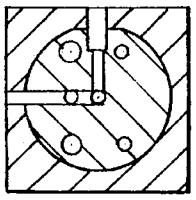
FIG.13E
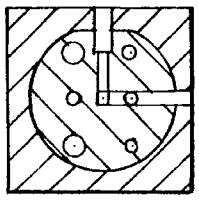
FIG.13A
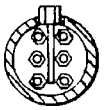
FIG.13H
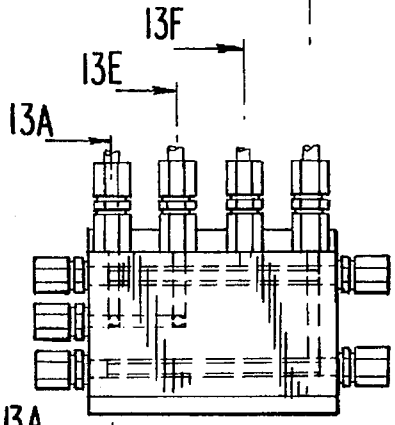
FIG.13B

DEVICE FOR HOOKING, LIFTING AND UNLOADING A DUSTBIN FOR USE ON SIDE LOADING GARBAGE TRUCK

FIELD AND BACKGROUND OF THE INVENTION

This invention provides a device for use on a side-loading garbage truck, for hooking, lifting and unloadig a dustbin, by means of a pivotable, compass type arm which is capable of extending to a position close to the dustbin pins, for hooking, lifting and maintaining the dustbin in a substantially vertical position and to cause it to tip after the dustbin has passed the threshold of the truck body loading opening.

Due to the peculiar features of kinematic motion used, all of the above movements can be carried out in a restrained space, to thereby permit the motor vehicle to further approach a dustbin during operation, and also, due to restricted strokes of actuators, to minimize the maneuvering time.

Furthermore, devices are provided by means of which the arms for gripping a dustbin are capable of self-centering in relation to the loading opening, so as to facilitate maneuvering by the operator, who has, thus, greater tolerance availability for hooking, while due to said self-centering capability of the dustbin with respect to a loading opening, this loading opening may be restrained in width.

In order to perform dumping of a dustbin, a garbage truck is generally used which has a refuse collection body and is provided with plungers designed for hooking a dustbin resting sidewise on the road, and for lifting and tipping the dustbin to drop refuse down into the truck body.

These motor vehicles have gripping means in the form of a telescopic arm capable of hooking a dustbin, and plungers that are capable of lifting the dustbin and causing it to tip for discharging.

Many types of kinematic motions have been designed for this purpose. By using these motions, the dustbin gripping means are caused to translate in two orthogonal directions or to perform a toro-translational motion to move the dustbin up to above the refuse collection body of vehicle.

A device for gripping, lifting and rotating a dustbin is known from Italian Patent Application N. MI92A 001906, which comprises dustbin gripping arms, dustbin lifting plungers and rotating means which are associated with a slide, the slide being movable towards and away from the dustbin and being mounted inboard the truck, said gripping means being a pair of pivoting arms hinged to the slide and carrying at their opposed ends a tubular element being rotatable about its own axis, having arms attached thereto for hooking the dustbin.

However, this solution is rather intricate and, thus, expensive to construct, and, furthermore, it requires that arms of considerable length are used in order that a desired height is reached and a restricted inclination of the dustbin is achieved.

Finally, said long arms require the truck to maintain a considerable distance to the dustbin during hooking operation.

SUMMARY OF THE INVENTION

The object of this invention is to provide a device for hooking, lifting and tipping a dustbin, which is simple in construction and which can operate in a restrained space wherein the dustbin can be maintained substantially vertically oriented during lifting thereof so as to perform rotation only near an end portion of its stroke, i.e. when the dustbin will have passed the threshold of the truck body loading opening.

In a preferred embodiment the device of the present invention is shaped so that it does not protrude from the side of the vehicle when driven on a road and the device is provided with arms restrained in length, such that gripping of the dustbin is permitted even when the dustbin is positioned very close to the vehicle and in a situation permitting the dustbin to be put into a downwardly rest position, underneath the platform of the vehicle body.

These and other objects of this invention are achieved by a device to be described hereinbelow in greater details by way of an example only, reference being to the accompanying drawings, wherein:

BRIEF DESCRIPTION OF THE DRAWINGS

FIGS. 13A to 13H show the hydraulic supply blocks and duct lines inside the rotatable tubular support according to the invention.

DESCRIPTION OF THE PREFERRED EMBODIMENTS

Figure 5:
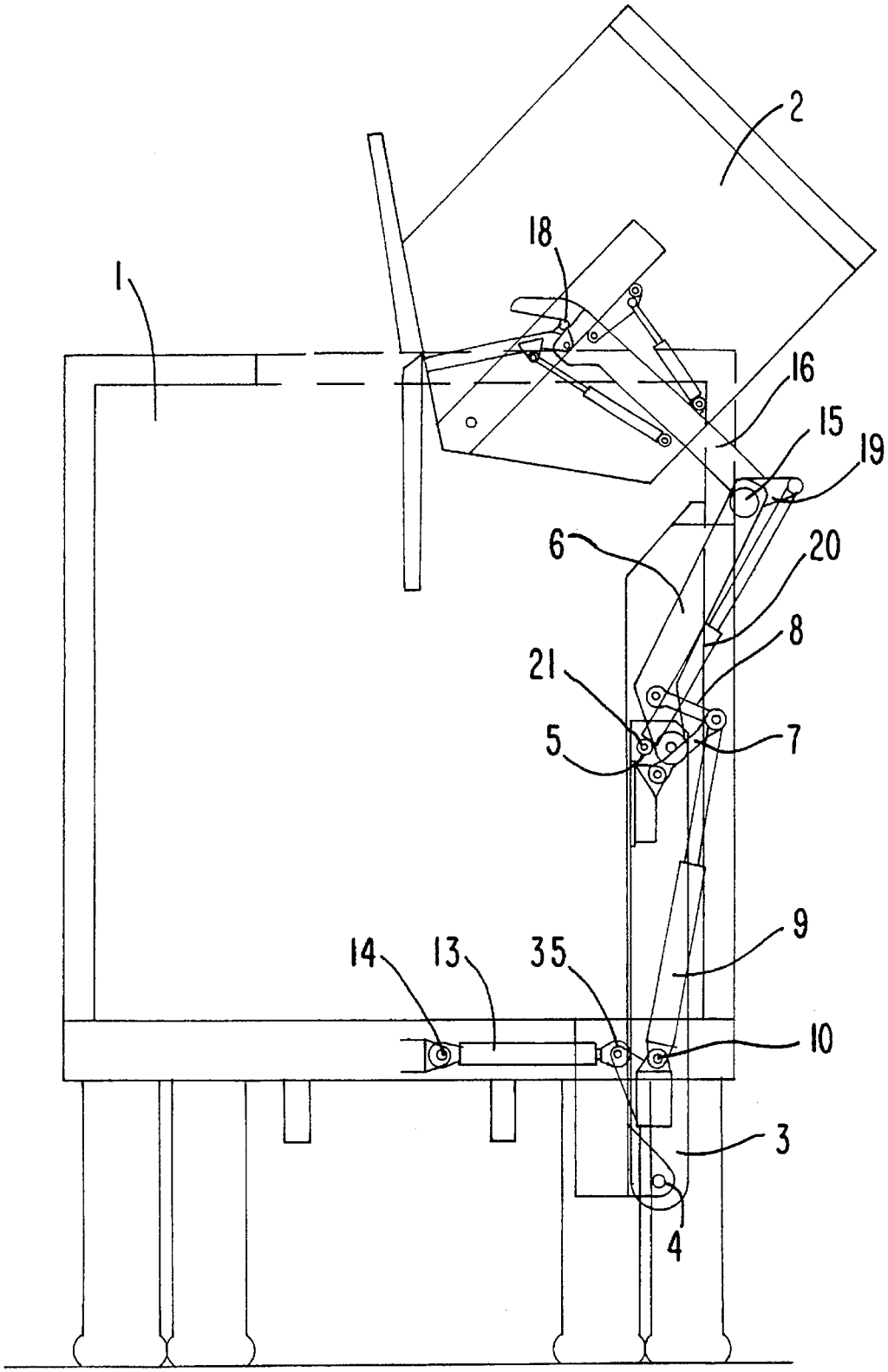
FIG. 5 is a schematic drawing shows the device after the dustbin has been rotated for unloading.

In FIG. 5, reference numeral 1 designates a truck body to which a device according to the invention for hooking and lifting a dustbin designated at 2 is associated.

Figure 4:
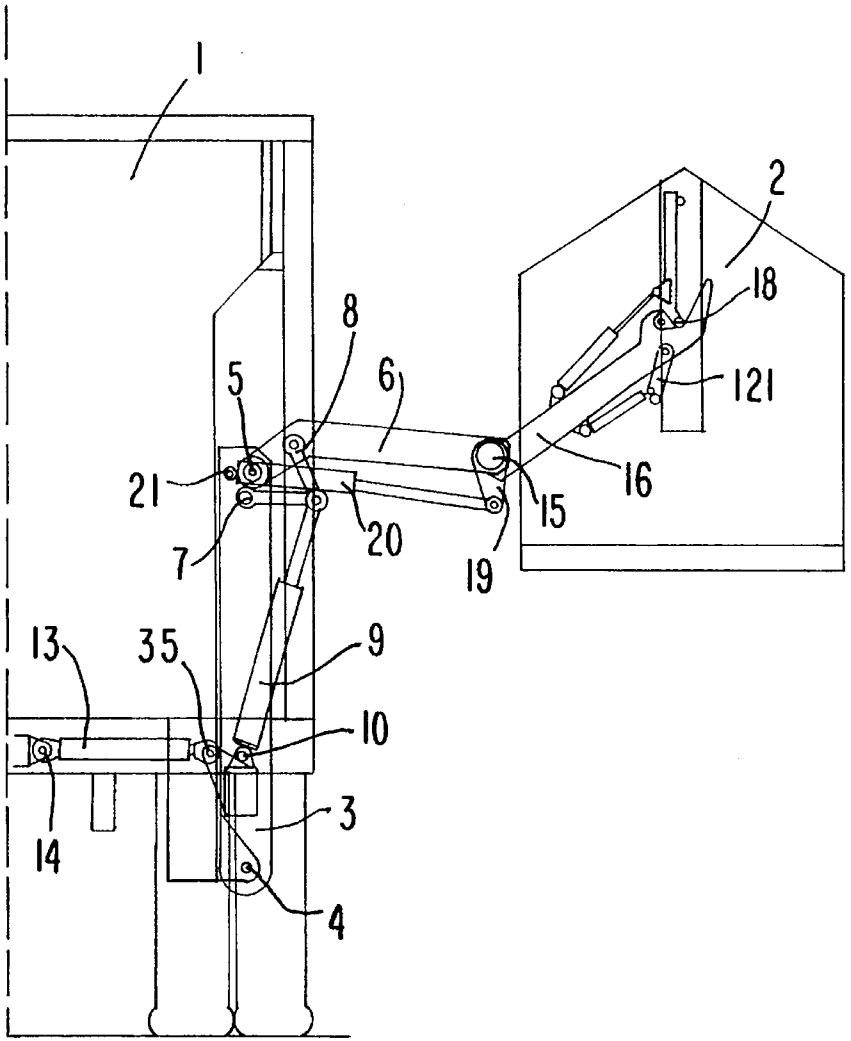
FIG. 4 is a schematic drawing showing the device in use, prior to rotating the dust bin.
Figure 10:
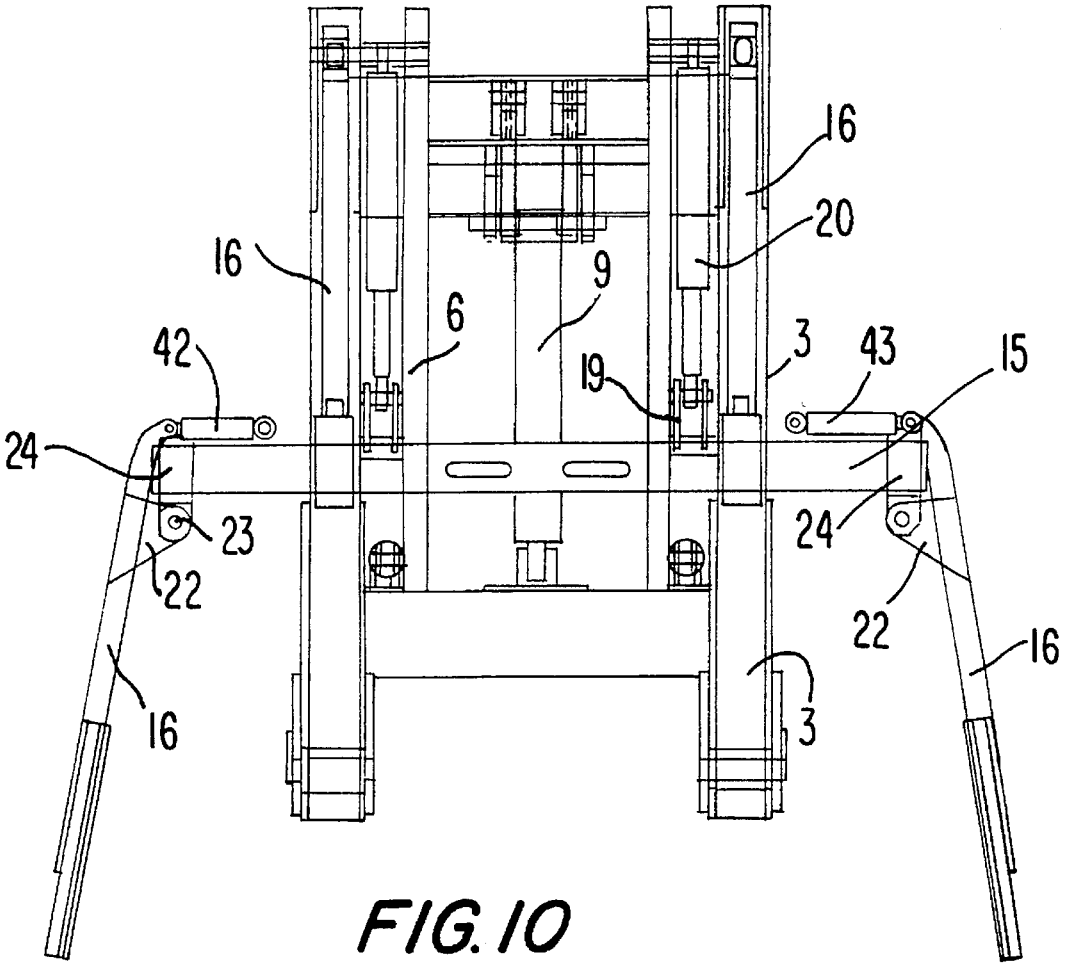
FIG. 10 is a front view of the device according to the invention.

This device as shown in FIGS. 4, 5 and 10 comprises a first a pair of arms 3 the lowermost ends of which are connected at hinges 4 to a pair of device supports secured to the truck frame while a pair of second arms 6 are connected to the other ends of arms 3, at hinges 5.

The arms 3 and 6 are connected by means of a pair of connecting rods, 7, 8, respectively, which are, on their opposite side, connected to the end of a plunger 9 connected at hinge or pivot 10 to a lower part of the first arm 3.

A second pair of plungers 13 are pivotally connected between the vehicle frame and the arm 3 at hinges 14, 35, respectively.

When plunger 13 is extended, the arm 3 is caused to pivot in a clockwise direction about hinge 4, whereas extension of the plunger 9 causes the connecting rods 7 and 8 to open apart, whereby the arms 3 and 6 are spread apart from one another.

Hinge between the outer ends of the pair of arms 6 is a tubular support 15 to which a pair of arms 16 are secured. Arms 16 are provided with a recess 17 (shown in FIG. 2) for enabling engagement with hooking pins 18 on the dustbin.

Secured to the tubular support 15 and, thus, the arms 16, is a lever 19 which is hinged to a plunger 20 having its opposite end hinged at 21 to the upright or arm 3 (see FIGS. 5 and 10).

Accordingly, the arm 6 (having a bend therein as shown in FIG. 5) and plunger 20 form the corresponding links of a four-bar linkage, which links are connected at one end of lever 19 and, at the other end, are hinged to the upper end of the upright or arm 3, at first and second pivot points 5 and 21.

Figure 1:
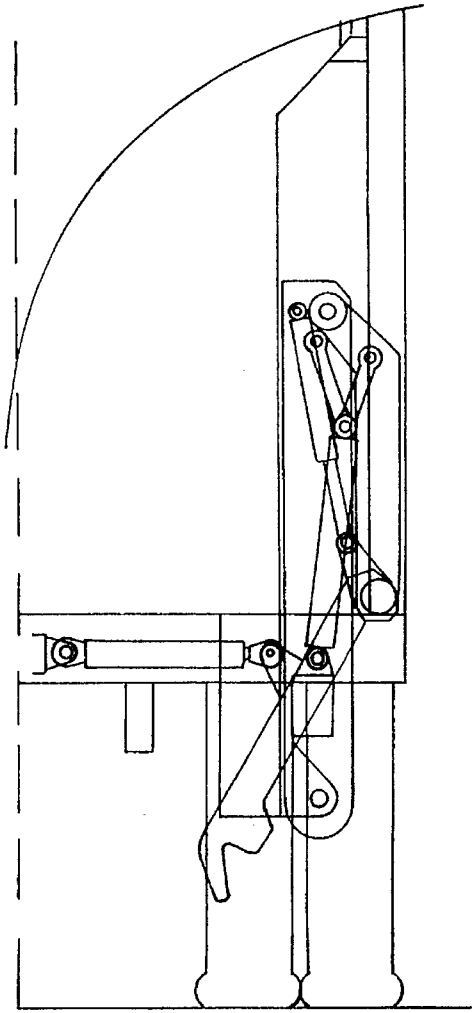
FIG. 1 is a schematic drawing showing a device for hooking, lifting, and rotating a dustbin according to this invention, the device being in its rest (closed) position.

One feature of the invention is that the line joining the hinging points 5 and 21 of arm 6 and plunger 20, respectively, is orthogonal to first arm 3 and is substantially aligned in a substantially horizontal direction, when said first arm 3 is in a retracted (vertical) position as seen FIGS. 1 and 5.

Figure 2:
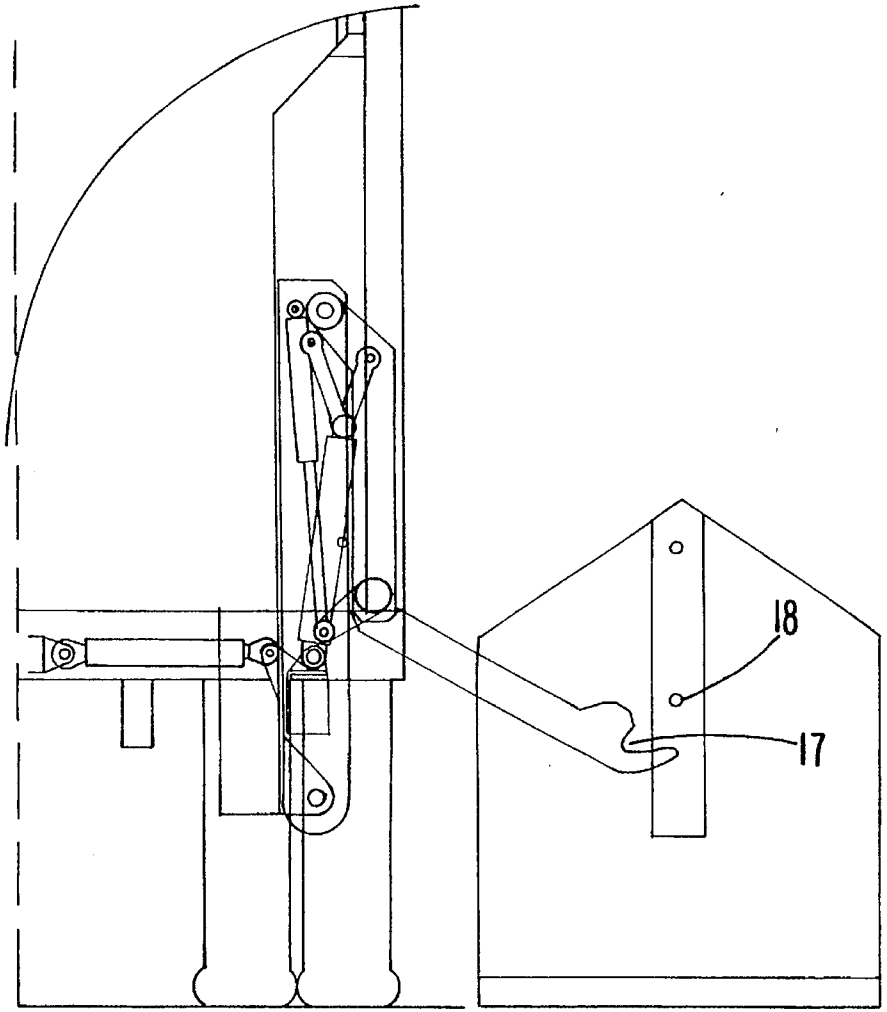
FIG. 2 is a schematic drawing of the device in FIG. 1 in a position enabling hooking and gripping a dustbin on the ground in an area of mimimum distance of the dustbin to the right side of the truck.

Furthermore, said plunger 20 consists of an extensible arm so as to cause said four-bar linkage to assume two different configurations providing for two distinct functions of the device, in relation to sequences of the operating cycle: a first configuration resulting from a first partial extension of said plungers (20) causing the arms 16 to be pivoted from a rest position underneath the platform of the truck body (FIG. 1) to a prelifting position with respect to a hooking pin on the dustbin, which configuration besides supporting said arms 16 is contributive in keeping their ends 17 at a same level above the ground during translation towards the dustbin for hooking it (FIG. 2).

Figure 3:
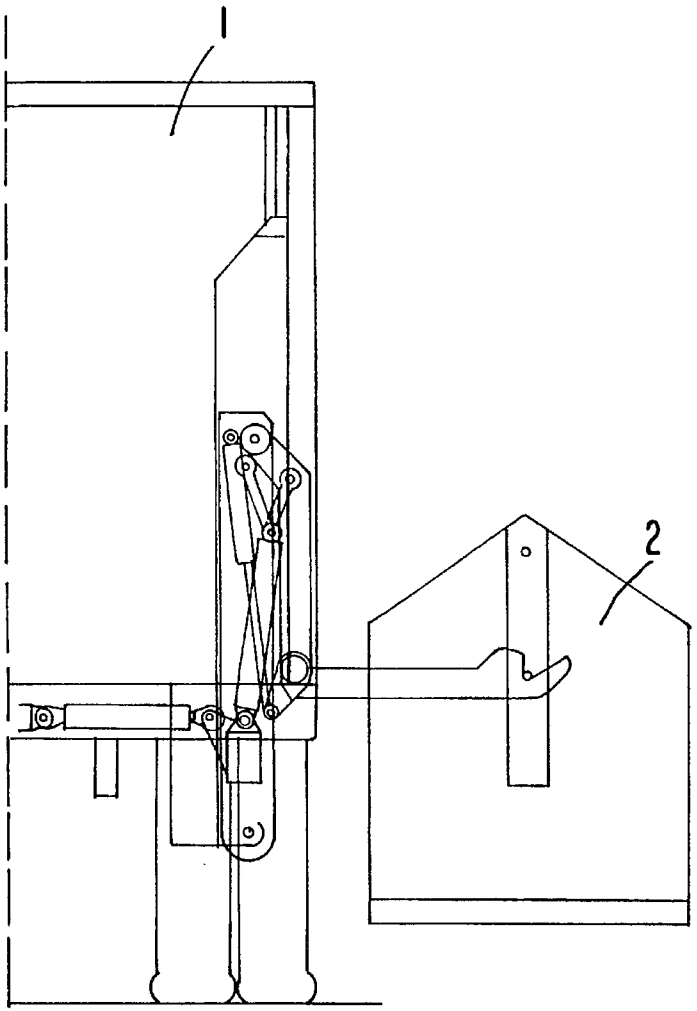
FIG. 3 is a schematic drawing showing the device of FIG. 1 in a position positions of pre-lifting and lifting, respectively, of the dustbin, before its rotation is started.
Figure 6:
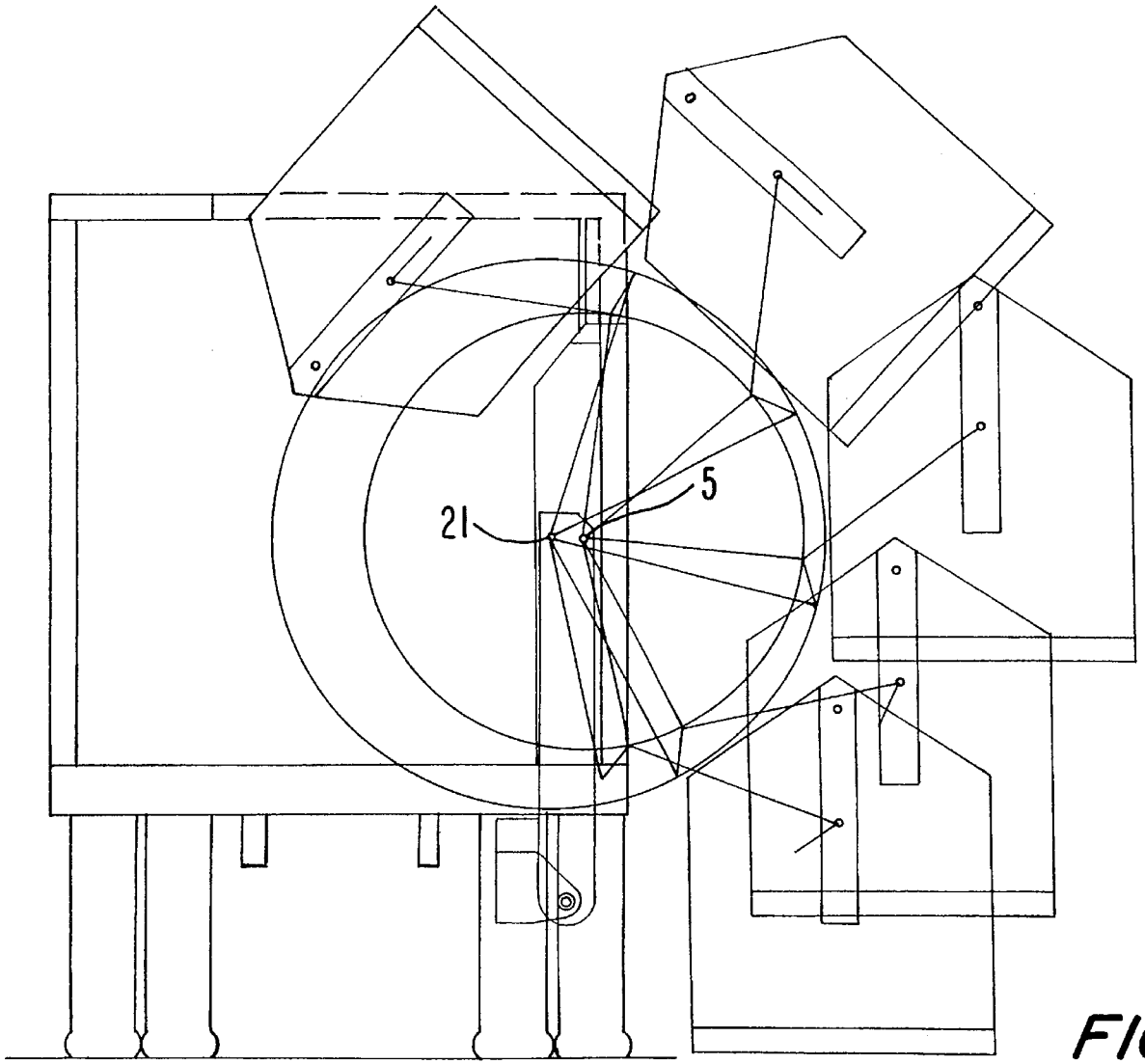
FIG. 6 is a schematic drawing showing the dynamics of dustbin lifting and rotating motions, outlining the two circular arcs of motion as described by the two linkage arms.

A second configuration is achieved as a result of said plungers (20) having performed a complete extension (end of stroke), causing the arms 16 to be further pivoted to produce a first small elevation of the bin from the ground (FIG. 3), configuration by means of which said linkage is such that the ends of the arm 6 and the plunger 20 will describe circular arcs with the centers 5 and 21 aligned on the horizontal, this particular conformation of the linkage achieving the desired purpose of maintaining the dustbin in a substantially vertical position during lifting to only perform one rotation in the final part of the path (see FIG. 6).

During all of these movements, the plunger 20 remains unchanged in length and, therefore, the plunger 20 will operate such as if it were a rigid rod.

Figure 8:
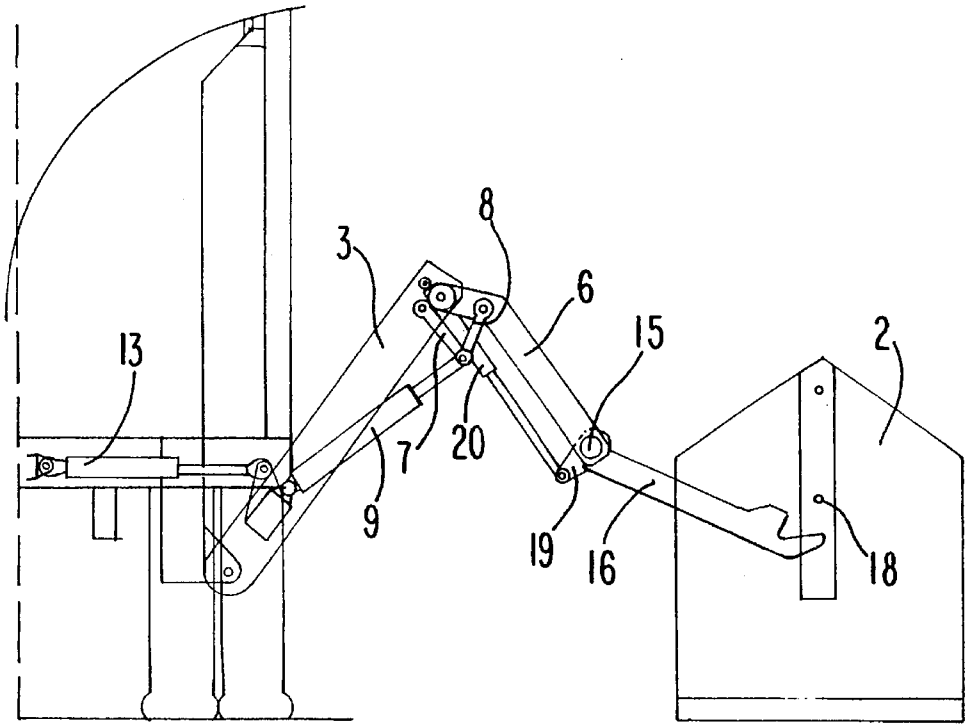
FIG. 8 is a scematic drawings of the device in a position of maximum extension of the device for hooking the dustbin.
Figure 7:
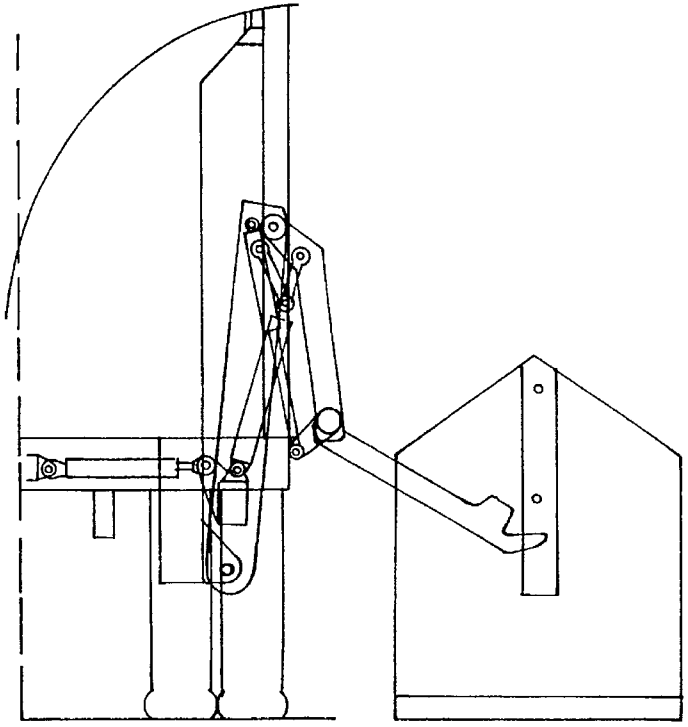
FIG. 7 is a schematic showing the device in FIG. 1 in an intermediate position of the device while moving towards the dustbin.
Figure 9:
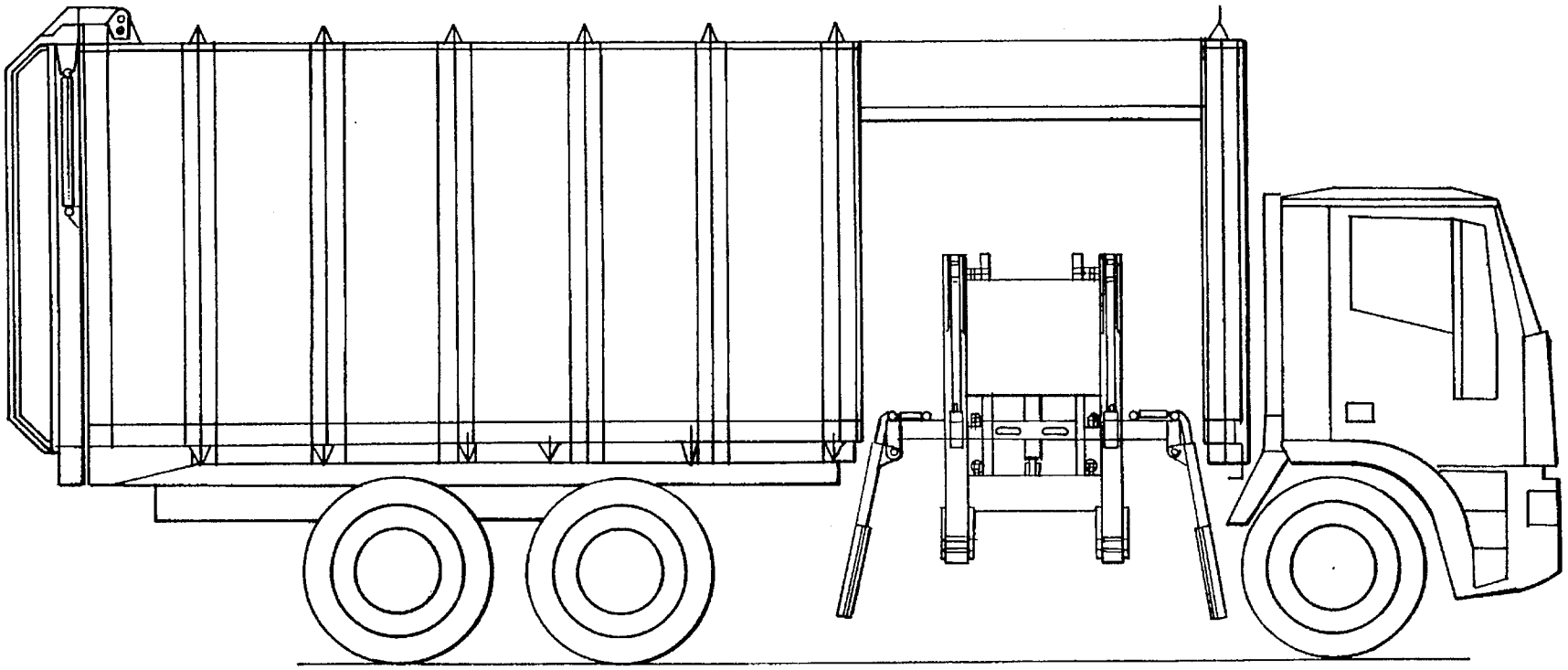
FIG. 9 is a front view of the device according to the invention along with the entire outline of the truck.

The plungers 9 and 13 are supplied via one and the same circuit, on which a flow distributor, not shown, is disposed and is adjusted so that the amounts of fluid conveyed to the two cylinders are such as to ensure a predetermined ratio between rotation of arm 3 about point 4 and rotation of arm 6 about point 5, whereby the end 17 of arm 16 will move to follow a substantially horizontal path (compare FIGS. 7 and 8).

Provided on arm 16 is also an abutment member 121 in FIG. 4, against which the surface of the dustbin will come to rest and which may cause an increment of rotation to be performed at the end of dustbin lifting stroke, if it is desired.

Figure 11:
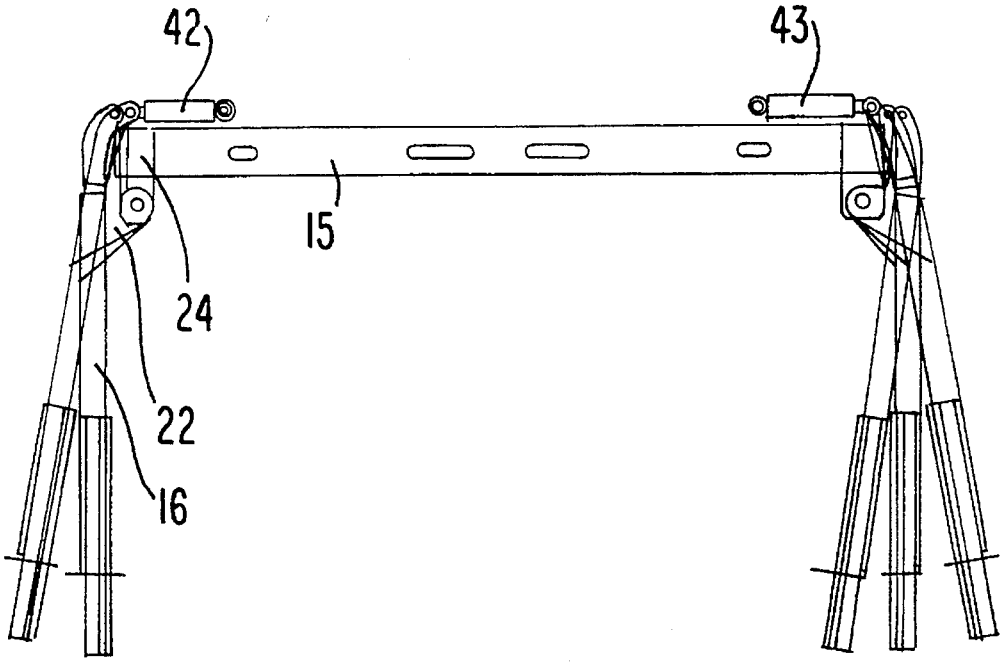
FIG. 11 is a plan view of the dustbin-gripping arms with the associated driving means, according to the invention.

The arms 16 are mounted to the tube support 15 in a rotatable manner as shown in FIGS. 10 and 11 about an orthogonal axis to the axis of the support itself.

In particular, with reference to FIGS. 10–11, a wing 22 or the like is welded to each of the arms 16 and is hinged at 23 near the ream of to a strap 24 mounted to the tubular support 15.

Thereby, the arms 16, with their associated wings 22, will provide corresponding centrally pivoted levers, which are hinged, at one end thereof, to a pair of plungers 42 and 43.

By operation of these plungers, the arms 16 may be caused to open from around the dustbin and then to close again around it.

According to a further feature of the invention, one of these plungers, the plunger 42 for example, can drive the movements of an associated arm from an open position to a closed position thereof in which the arm is substantially orthogonal to support 15.

On the contrary, the second plunger, the plunger 43 in this case, has twice the stroke of the plunger 42, and it can thus control the movements of the associated arm between an open and a closed position, which are both symmetrical in relation to the position in which the arm is orthogonal to support 15 (FIG. 11).

Therefore, while the first of the two arms may be shifted from a position that could be defined as an "open" position, such as shown by outer positions of arms 16 in FIG. 11, to a "closed" position in which the arm is orthogonal to the support, the second arm may be driven from an open position, symmetrical to the position of the first arm, to an orthogonal position to support 15 and then, in continuing its closure stroke, to a closed position in which the arm assumes a position being parallel to what is the open position of the adjoining arm.

This configuration permits the positioning operation to be considerably facilitated by the vehicle driver, because a perfect aligning of the bin with the gripping devices is no longer necessary.

In fact, it is only necessary for the driver to set the vehicle so as to have one arm, in particular the one having less magnitude in movement, placed close to an edge of the bin.

The driver moves the arms 16 until one arm 16 engages the bin edge, whereafter the driver causes the arm to close with the aid of the pistons 42 and 43. The first arm securely engages a respective pin provided on the bin wall, and this as a result of the positioning of the vehicle in relation with the bin.

Now, by operation of the cylinder 43, the second arm can be rotated until this second arm having passed its orthogonal position to the associated support it becomes parallel with the other arm, so as to engage the pin provided on the opposite wall of the bin.

Once the bin is lifted off the ground, both arms can be rotated in a same direction so as to bring the bin back to the center with respect to the loading opening on the vehicle, which is in fact obtained at the end of of the cylinder 42 stroke.

Figure 12:
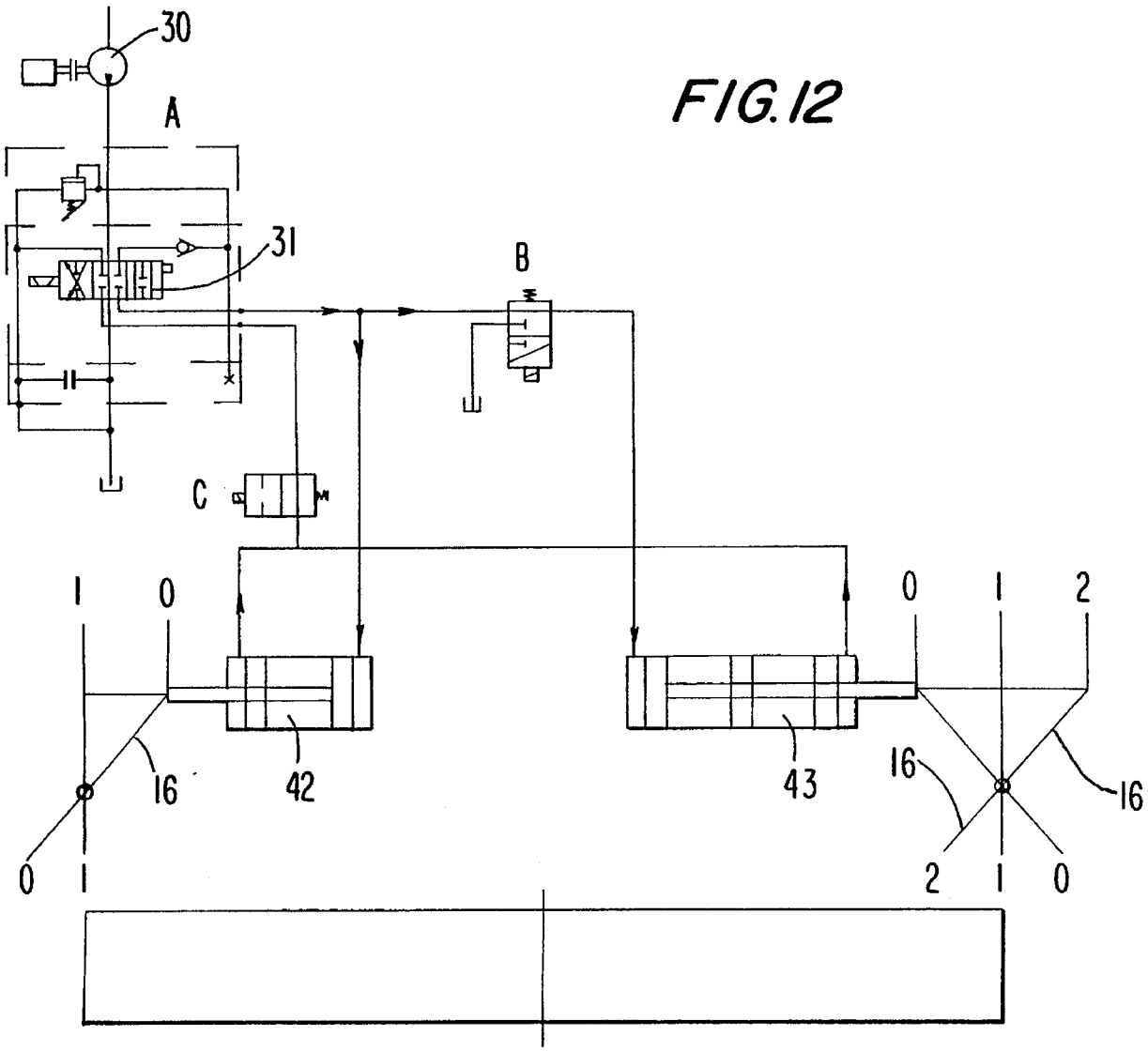
FIG. 12 is a diagram of a hydrulic circuit for operating the gripping arms according to the invention.

The hydraulic circuit driving the pistons 42 and 43 is schematically shown FIG. 12.

A pump 30 pumps pressurized fluid into a distributor and from here to the pistons 42 and 43.

The piston 42 is extended to close the associated arm 16 until this encounters the wall of the bin.

Similarly, the piston 43 is extended to close the associated arm 16 against the opposite bin wall.

When the bin is off the ground and is thus able to freely move in a direction parallel to the axis of the tubular support 15, the deflectors are acted upon in order to pump fluid into plunger 42 until the associated arm is moved to an orthotonal direction to the direction of the support, whereas oil out of the plunger 42 is now conveyed towards plunger 43 in order to cause the plunger to retract thereby to bring the associated arm also in a position orthogonal to the support and oil out of plunger 43 goes to a collecting tank.

Oil from piston 42 goes, on the contrary, to a storage tank. Operation is as follows:

The conductor drives the vehicle close to the dustbin and, at this time, a reference mark painted on the bin is displayed within a frame on a camera, to permit the driver to position the vehicle with sufficient approximation (this visualized system of position sensing is well known to the state of the art and does not requires, therefore, any further explication).

With the truck stopped, the driver starts approaching the arms 16 to bin.

Firstly, the operator acts on plunger 20 to cause the arm 16 to move out of the vehicle outline to operative position shown FIG. 2.

When this position is reached, operation of the plunger 20 is stopped and the plunger 20 is maintained at its attained length until approach of arms to the bin is completed.

Now, the plunger 13 is acted upon and its extension causes the upright arm 3 to rotate clockwise about the hinging point 4.

At the same time, a portion of the same fluid supplied to the plunger 13 flows into plunger 9 via the hydraulic distributor.

Extension of the plunger 9 causes the connecting rods 7 and 8 to spread apart, as a result of which arm 6 is rotated in an opposite direction to arm 3.

During this movement, the arm 16, that is secured to lever 19, is caused to rotate about the axis of tubular support 15 as a result of the plunger 20 (which, as remembered, does not extend during this step) being acting on lever 19, thereby contributing in keeping the ends 17 of arms 16 to a same height from ground during translation.

According to the invention, the hydraulic distributor is calibrated so that rotation ratio between arms 3 and is such that during movement the end 17 of arm 16 will be always substantially maintained at a same height, so as to securely engage the projecting pins on bin walls.

When this position is reached, the plunger 20 is further extended right to the end of stroke thereby to cause the lever 19 and arm 16 to rotate about the support 15 to have the bin slightly lifted off the ground.

Extension of piston 20 is again stopped, the plunger 13 is retracted, whereby the plunger 13 brings the upright or arm 3 back to vertical position to approach in part the bin to the vehicle and, at the same time, to move it to a lifted position, whereafter the plunger 9 is extended further to complete lifting of the bin up to the dumping area, where tipping is performed.

According to a further advantageous feature of the invention, the supply to the different hydraulic actuators provided at the ends of the tubular support 15 and the two gripping arms 16 takes place through ducts lines inside the tube support 15 itself (FIGS. 13A to 13H).

It should be in fact considered that for said plungers to be supplied in the embodiment shown, as many as eight conducts for pressurized fluid are necessary, and if hoses were to be used, their bulky volume would not permit them to pass through the interior of the tubular support (15). Due to this support 15 having to rotate about its own axis together with the two arms 16 secured thereto, whereupon to describe an arc of a circle with a radius corresponding to arm (6), the above-mentioned hoses would clearly imply a great hindrance problem.

For this reason, a plurality of conducts are advantageously provided inside the tubular support 15, these conducts being coupled, on one side, to a supply block provided with eight connections for a corresponding number of hoses which are thus joined together in the middle part of the device (FIG. 13D) and, on the other side, to a set of connections provided at the ends of support 15, to which connections flexible unions are coupled whose length is restricted, but sufficient to provide supply for the differents actuators.

Though a preferred embodiment of this invention has been described herein above by way of an example only, it should be understood that number of modifications and variations may be conceived and made thereto by any person of ordinary skill in the art, without departing from the spirit and scope of our inventive idea.

We claim:

1. A device for use in a truck having a side loading arrangement for hooking, lifting and unloading a dustbin having pins, while initially maintaining the dustbin in a substantially vertical position, the truck having a pair of device supports, the device comprising:

a pair of first arms (3) each having a lower end hinged to one of the device supports;

a pair of first plungers (13) connected between the respective pair of first arms and the truck for pivoting the first arms about the lower ends of the first arms, outwardly and inwardly with respect to the truck;

a pair of second arms (6) hinged to respective top ends of said pair of first arms (3), at a pair of first pivot points (5);

a pair of second plungers (9) respectively connected between said pairs of first and second arms for pivoting said second arms with respect to said first arms about said first pivot points, each of said pair of second arms having an outer end spaced away from said pair of first pivot points;

a pair of third arms (16) hinged respectively to the outer ends of said pair of second arms, each of said third arms having an inner end and an outer end;

means at the outer end of each of said pair of third arms, for forming a recess (17) at the outer end of each of said third arms, for hooking a pin of the dustbin;

a tubular support (15) connected between the inner ends of the pair of third arms;

a pair of levers (19) connected to said tubular support (15) each lever having an outer end;

a pair of third plungers (20) each having an inner end hinged to the outer end of one of said pair of levers (19), each third plunger having an outer end hinged to the top end of one of said first arms (3), each at a second pivot point (21); and said first and second pivot points (5, 21) being positioned on said top end of each of said first arms (3) and a shape of each of said pair of second arms (6), and a length of said pair of levers (19) being selected so that each second arm (6), with each respective third plunger (20) and said levers (19), forming a pair of four-bar linkages between said pair of first arms (3) and said pair of third arms (16), each of the first arms (3) having a longitudinal extent, a line between said first and second pivot points at the top end of each of said first arms, extending orthoganally to said longitudinal extent, said longitudinal extent extending vertically and said line extending horizontally when the pair of first arms (3) is in a retracted position in the truck.

2. A device according to claim 1, wherein said pair of third plungers (20) have a retracted position so that, with said pair of second arms extending substantially parallel to said pair of first arms, said pair of third arms (16) are retracted against the truck, said pair of third plungers (20) having a partly extended position for pivoting said pair of third arms (16) to move said recesses (17) away from the truck and under pins of a dustbin next to the truck, said pair of third plungers (20) having a fully extended position for pivoting said pair of third arms (16) further for lifting said pair of recesses (17) to partly lift a dustbin next to the truck, after the recesses (17) have engaged the pins of the dustbin, the four-bar linkage being constructed so that with extension of said second and third plungers, said second arms (6) pivot to raise the dustbin with pins engaged in the recesses (17) while maintaining the dustbins substantially vertically and while maintaining the line between said first and second pivot points to be substantially horizontal.

3. A device according to claim 1 including pivoting means connected to said pair of first and second plungers (13, 9), for pivoting said pair of first arms (3) while simultaneously pivoting said pair of second arms (6) for moving the tubular support in a horizontal plane and at a single distance above ground.

4. A device according to claim 3, wherein said pivoting means comprises hydraulic fluid distributor means connected to said first and second plungers (13, 9) to maintain a preset ratio of hydraulic fluid being supplied to said first and second plungers.

5. A device according to claim 1, wherein said third arms (16) are pivotally connected to outer ends of said tubular support (15) for pivotable movement about an axis which is transverse to a longitudinal axis of said tubular support, a fourth plunger (42) is connected between one of said third arms (16) and said tubular support for moving said one of said third arms and a fifth plunger is connected between the other of said pair of third arms (16) and said tubular support for moving the other third arm, said fourth and fifth plungers being connected to said third arms for moving said third arms by different amounts.

6. A device according to claim 5, wherein said fourth plunger is connected between said tubular support and the one of said third arms for pivoting the one of said third arms between an outer position which is not orthogonal to the longitudinal axis of the tubular support, to an inner position which is orthogonal to the longitudinal axis of the tubular support, said fifth plunger being connected between said tubular support and the other of the third arm for pivoting the other third arm between an outer position which is not orthogonal to the longitudinal axis to the tubular support, to an inner position which is not orthogonal to the longitudinal axis of the tubular support, past a position at which the other third arm is orthogonal to the longitudinal axis of the tubular support.

7. A device according to claim 6, including hydraulic means connected to said fourth and fifth plungers for coordinating movement of the fourth and fifth plungers to center a dustbin having pins engaged with the recesses, between the third arms, after the dustbin has been lifted from the ground, to move the third arms so that they both extend in a position orthogonal to the longitudinal axis of the tubular support.

8. A device according to claim 7, wherein the hydraulic means comprises passages defined in the tubular support for supplying hydraulic fluid to and from the fourth and fifth plungers.

9. A device according to claim 1, wherein said second arms (6) each have a bend therein.

10. A device according to claim 9, including a first connecting rod connected between an outer end of said second plunger and said top end of said first arm, a second connecting rod connected between the outer end of said second plunger and said second arm, adjacent the bend in said second arm.

* * * * *